US005435106A

United States Patent [19]

Garries et al.

[11] Patent Number: 5,435,106

[45] Date of Patent: Jul. 25, 1995

[54] METAL REINFORCED MULLION FOR WINDOWS

[75] Inventors: Ray Garries, Springboro; Jonathan C. Hauberg, Beavercreek; David A. Stammen, Springboro, all of Ohio

[73] Assignee: Aluminum Company of America, Pittsburgh, Pa.

[21] Appl. No.: 183,190

[22] Filed: Jan. 18, 1994

[51] Int. Cl.[6] ..... E06B 1/32

[52] U.S. Cl. ..... 52/204.5; 52/730.3; 52/730.4; 52/656.6; 52/734.1; 49/DIG. 2

[58] Field of Search ..... 52/204.5, 727, 730.4, 52/730.3; 49/DIG. 1, DIG. 2

[56] References Cited

U.S. PATENT DOCUMENTS

| | | | |
|---|---|---|---|
| 3,090,083 | 5/1963 | Emmerich | 52/727 |
| 3,302,354 | 2/1967 | Mermell . | |
| 3,348,349 | 10/1967 | Petersen | 52/727 X |
| 3,703,063 | 11/1972 | Budich et al. | 52/727 |
| 3,918,231 | 11/1975 | Kessler . | |
| 4,875,311 | 10/1989 | Meyers | 52/730.4 X |

FOREIGN PATENT DOCUMENTS

| | | | |
|---|---|---|---|
| 0153758 | 9/1985 | European Pat. Off. | 52/204.5 |
| 3231876 | 3/1984 | Germany | 52/204.5 |
| 9413920 | 6/1994 | WIPO | 52/204.5 |

OTHER PUBLICATIONS

"Anderson Reinforced Joining System", Anderson Corp., Feb. 27, 1992.

*Primary Examiner*—Carl D. Friedman
*Assistant Examiner*—Christopher Todd Kent
*Attorney, Agent, or Firm*—Glenn E. Klepac

[57] ABSTRACT

A window assembly includes adjacent first and second windows and a reinforcing mullion connecting the windows. The mullion comprises hollow polymeric first and second lineals and a metal reinforcing bar between the lineals. Interior and exterior face caps attached to the lineals span a gap between them. A securement means is also provided for connecting an end portion of the metal reinforcing bar to a support structure surrounding a window opening in a building. The mullion adds rigidity to the assembly, thereby increasing its design allowable size.

22 Claims, 6 Drawing Sheets

METAL REINFORCED MULLION FOR WINDOWS

FIELD OF THE INVENTION

The present invention relates to a window assembly comprising windows made with polymer frames. In the invention described herein, the window assembly includes a mullion reinforced with metal to enhance structural rigidity of the assembly.

BACKGROUND OF THE INVENTION

Window frames traditionally have been made from wood or metal or various combinations of wood and metal. In recent years, windows with hollow polymer frames are becoming more popular because of improved thermal properties, lower cost and relative ease of manufacture, assembly and installation compared with wood and metal windows. As used herein, the terms "polymer" and "polymeric" refer to window components in which a polymer such as polyvinyl chloride is the principal constituent. Such components may also contain various other ingredients such as fillers, glass reinforcing fibers, processing aids and impact modifiers. All window assemblies are limited in size by the requirement that they withstand design windloads as established by local building codes and ordinances. Windloads, window sizes and window glass thickness are factors in determining whether maximum deflection of the window assembly exceeds 1/175 of its length when subjected to the design load, as set forth in ASTM E-1300. Also included in the requirements is a maximum allowable deflection of 0.75 inch regardless of the window length. Accordingly, there is a need to provide polymer windows with reinforcements so that they are able to withstand design windloads when several such windows are combined into a unitary assembly.

Windows made from various combinations of polymer and metal components are known in the prior art. However, these prior art windows generally suffer from one or more serious disadvantages making them less than entirely suitable where large windloads are encountered or where the windows have an unusually large size. For example, Mennell U.S. Pat. No. 3,302,354, describes a window assembly having an exterior frame made from extruded aluminum sections and an interior frame formed of sections of extruded vinyl material. Kessler U.S. Pat. No. 3,918,231, claims a window frame construction comprising a metal frame having extruded aluminum members covered on its interior side by extruded plastic members. Windows shown in the Mermell and Kessler patents perform adequately as single units, but they do not possess sufficient strength and rigidity to withstand extreme windloads or to be combined into large multi-unit assemblies.

A principal objective of the present invention is to increase the rigidity of a window assembly.

A related objective of the invention is to provide a metal reinforcement for enhancing the rigidity and stability of a window assembly.

Another objective of the invention is to provide a securement means for anchoring the window assembly to a support structure surrounding a window opening in a building.

Additional objectives and advantages of our invention will become apparent to persons skilled in the art from the detailed description that follows.

SUMMARY OF THE INVENTION

In accordance with the present invention, there is provided a window assembly made up of two or more adjacent windows. Frames of the windows are preferably made from hollow, rigid polymer extrusions.

Windows in the assembly are preferably generally rectangular, and they each include elongated stiles, a sill and a rail. The window assembly includes a reinforcing mullion comprising first and second mullion halves or lineals each defining an elongated groove opening toward each other.

In order to enhance structural rigidity of the window assembly, a metal reinforcing bar is provided between adjacent lineals. The metal reinforcing bar preferably comprises an aluminum alloy or steel, or a combination of aluminum alloy and steel components. The reinforcing bar comprises a blade and a hollow first beam having portions extending laterally outwardly from the blade and into a groove in each of the adjacent mullion halves. As used herein, the terms "outward" and "outwardly" refer to a direction away from the middle of a window in its plane, and the terms "inward" and "inwardly" refer to a direction toward the middle of a window in its plane. The terms "interior" and "interiorly" refer to a direction toward the inside of a building in which a window is mounted, normal to the plane of the window. The terms "exterior" and "exteriorly" refer to a direction toward the outside of a building in which a window is mounted, normal to the plane of the window.

In a first embodiment of the reinforcing bar, the metal blade includes an interior end spaced interiorly from the first beam and an exterior end spaced exteriorly from the first beam. The exterior end is spaced farther from the first beam than the interior end so that an exterior portion of the blade (between the first beam and exterior end) is larger than an interior portion of the blade (between the first beam and the interior end). In the first embodiment, the reinforcing bar is preferably made from steel.

In a second embodiment, the metal reinforcing bar includes a second beam extending laterally outward from the blade. The second beam includes portions adjacent interior portions of both windows adjacent the bar. The second beam is preferably covered by an elongated interior face cap of extruded rigid plastic material. In this embodiment, the metal reinforcing bar is preferably an aluminum alloy extrusion.

In a third embodiment intended for the most demanding conditions, the metal bar is an aluminum alloy extrusion in which the second beam defines an elongated hollow cavity. An elongated steel bar is inserted into the cavity to provide even greater rigidity than is attainable with an extruded aluminum alloy bar alone.

Mullion halves or lineals joined by the metal reinforcing bar define an elongated, narrow gap between them. In all three embodiments described above, an exterior face cap is preferably applied over this gap by attachment to exterior portions of the adjacent windows. In the first embodiment described above, an interior face cap attached to interior portions of the windows closes the gap on its interior side, similar to the exterior face cap. In the second and third embodiments, the second beam overlaps the gap. A face cap is applied over the second beam, mainly to improve appearance of the window assembly.

A securement means is also provided for attaching the metal reinforcing bar to support structures around window openings in buildings where the window assembly is installed. The support structure generally includes two horizontal and two vertical wood studs, all defining a generally rectangular window opening. The securement means may attach the reinforcing bar to a horizontal stud or to a vertical stud, depending upon orientation of the reinforcing bar.

Usually, the reinforced mullion of the window assembly extends vertically, and the securement means provides attachment to the bottom and top, generally horizontal support studs. Occasionally, the reinforced mullion of the invention may extend horizontally. Then, the securement means provides attachment to the lateral, vertically extending support studs.

In a preferred embodiment, the securement means includes a metal plate for attachment to the building support structure and two metal posts connecting the metal plate to the metal reinforcing bar. The first beam is hollow and has an end aperture adjacent the metal plate. Proximal portion of the metal posts are inserted into the end aperture, and distal portions of the metal posts are connected to the metal plate. In a particularly preferred embodiment, the metal posts comprise bolts having a threaded proximal portion or shaft threaded into the end aperture. The distal portion is a bolt head having a larger diameter than the proximal portion. The bolt head is positioned adjacent a stud in the support structure with the proximal portion extending through an opening in the plate smaller than the head.

DETAILED DESCRIPTION OF THE PREFERRED EMBODIMENTS

Figure 1:
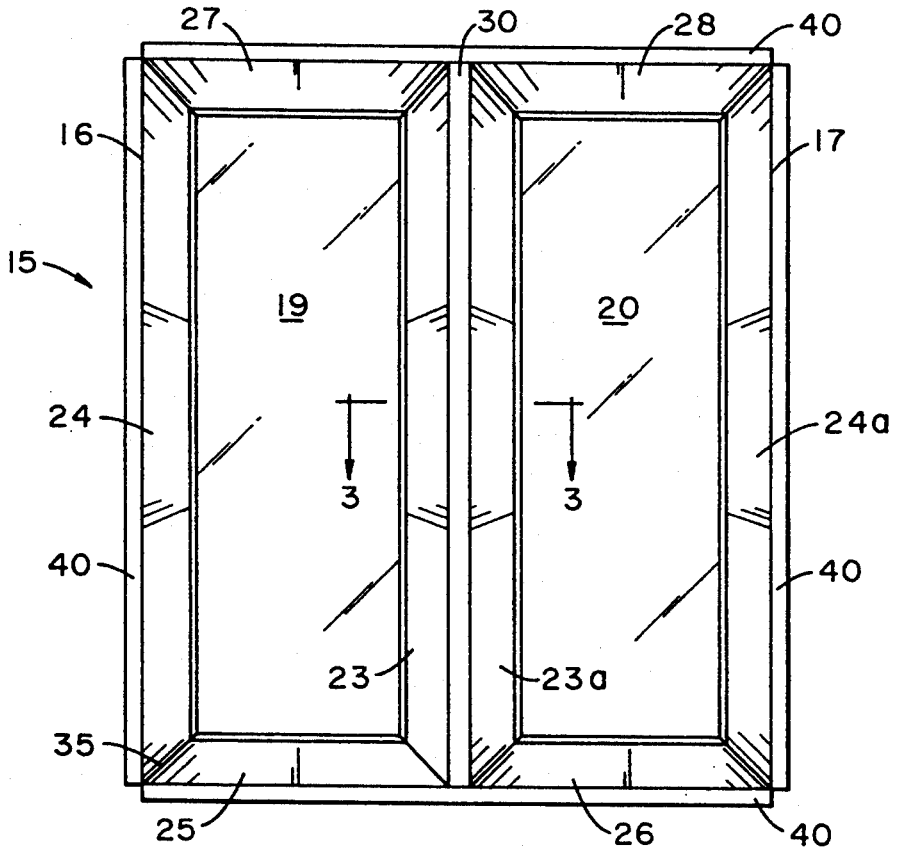
FIGS. 1 and 2 are front elevational views of window assemblies made in accordance with the present invention viewed from the interior of a building in which the window assemblies are installed.

A particularly preferred window assembly 15 shown in FIG. 1 includes two laterally adjacent window units having hollow plastic frames 16, 17 supporting glass window panes 19, 20. The frames 16, 17 include inner jambs **23, 23*a* and outer jambs 24, 24*a* both connecting bottom sills 25, 26 to heads or rails 27, 28. A centrally located mullion 30 interconnects the frames 16, 17 to improve structural rigidity of the assembly 15**.

The frame members **23, 23*a*, 24, 24*a*, 25, 26, 27, 28 are extruded from a rigid vinyl compound having a durometer hardness of about 105–110, and they are rigidly connected by fusion welded, mitered corner joints 35. The frames 16, 17 also include an outwardly projecting nailing flange 40. The window frames 16, 17 are manufactured with nailing flanges 40 extending around all four sides. However, the flanges on inner jambs 23, 23*a* adjacent the mullion 30** are trimmed away at the building site before assembly into final form.

Figure 2:
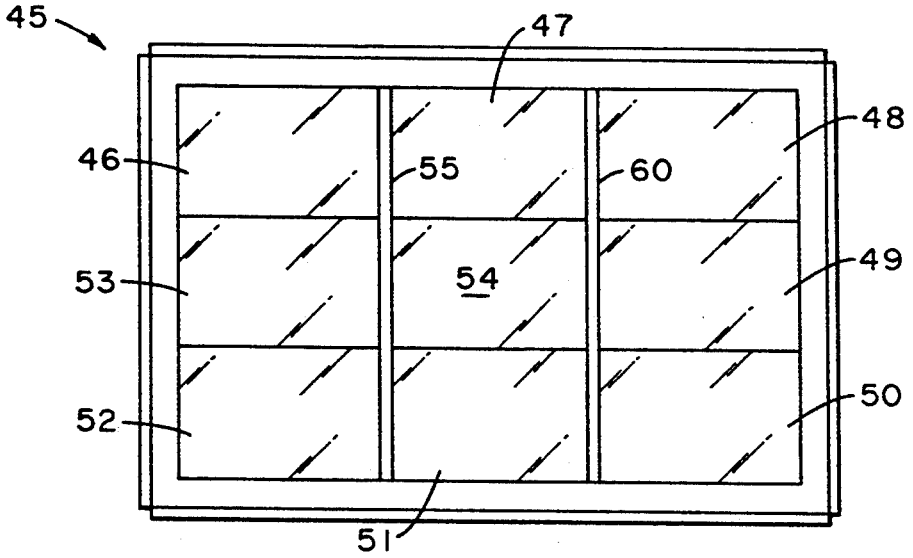

A second window assembly 45 of the invention, shown in FIG. 2, includes nine window units 46, 47, 48, 49, 50, 51, 52, 53, 54 having hollow plastic frames, mitered corners and nailing strips as described above. Two vertically extending mullions 55, 60 add structural rigidity to the assembly 45.

The two particularly preferred window assemblies 15, 45 shown in FIGS. 1 and 2 are casement windows. However, metal reinforced mullions of the present invention are also suitable for use with other types of fenestrations including but not limited to sliding sash windows, picture windows, awning windows, jalousie windows, tilt and turn windows and patio doors of all types.

Figure 3:
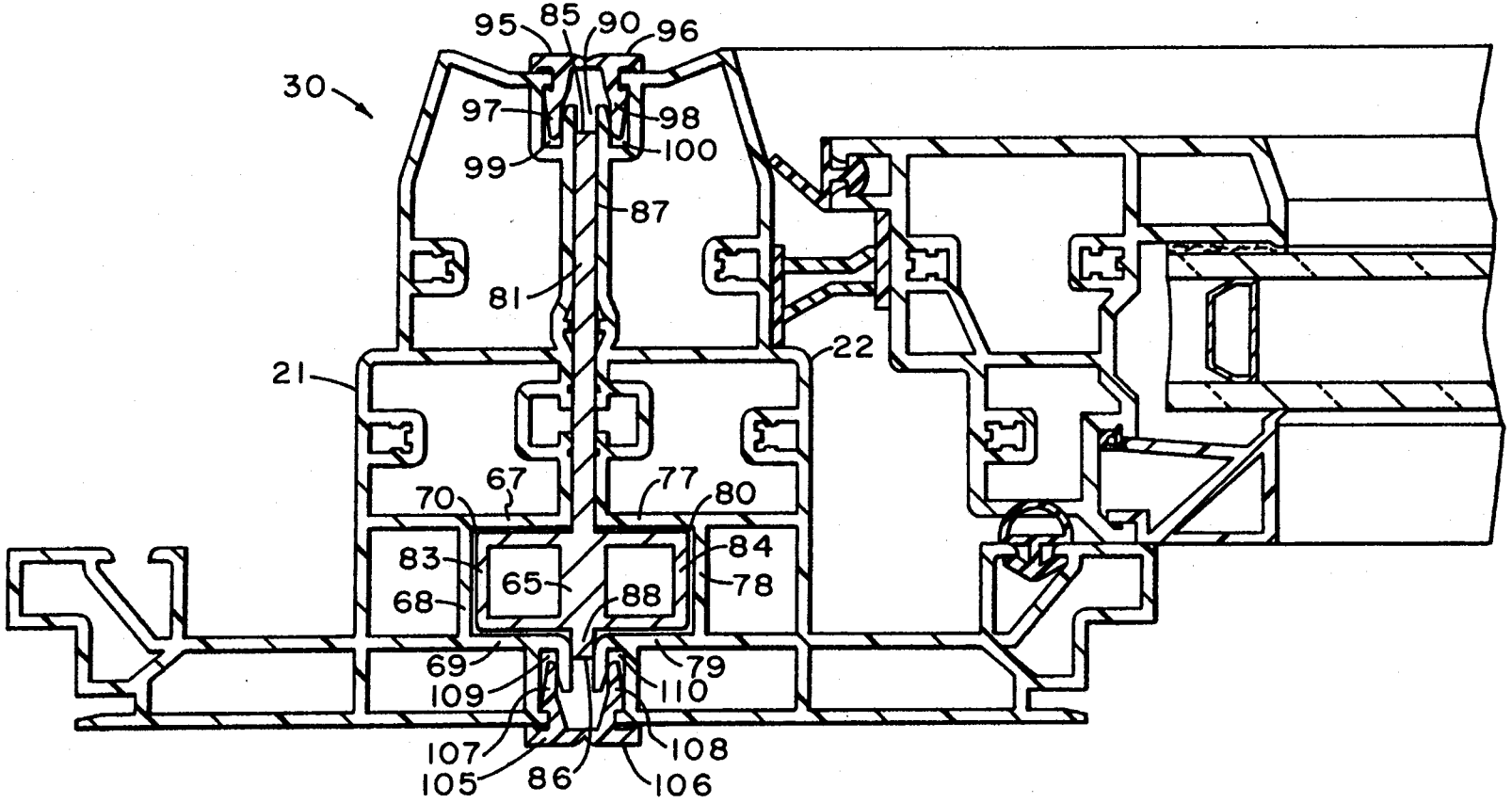
FIG. 3 is a cross-sectional view taken along the lines 3—3 of FIG. 1.

A first preferred mullion 30 of the invention is shown in FIG. 3. The mullion 30 includes a metal reinforcing bar 65 joining a first lineal 21 to a second lineal 22. The first lineal 21 includes elongated internal walls 67, 68, 69 defining an elongated first channel 70. The second lineal 22 includes elongated internal walls 77, 78, 79 defining an elongated second channel 80.

The metal reinforcing bar 65 is a steel bar having an elongated, thin blade 81 disposed between the two mullion halves 21, 22 and a first beam 83, 84 including a first portion 83 and a second portion 84. The beam portions 83, 34 are welded to the blade 81. The first portion 83 fits snugly within the first channel 70, and the second portion 84 fits snugly within the second channel 80. The blade 81 includes an exterior end 85 extending exteriorly from the first beam 83, 84 and an interior end 86 spaced interiorly from the beam 83, 84. The exterior end 85 is spaced farther from the beam 83, 84 than the interior end 86. Accordingly, an exterior portion 87 of the blade 81 between the beam 83, 84 and exterior end 85 is much larger than an interior portion 88 between the interior end 86 and beam 83, 84.

The blade 81 fits into an elongated narrow gap 90 between the mullions 21, 22. Two face caps 95, 105 are provided to close off this gap 90, thereby enhancing structural stability, appearance and thermal performance of the assembly 15. An exterior face cap 95 includes an exterior face cover 96 connected to legs 97, 98 inserted into exterior slits 99, 100 defined by elongated exterior walls of the mullion halves or lineals 21, 22. An interior face cap 105 includes an interior face cover 106 connected to legs 107, 108 inserted into interior slits 109, 110 defined by elongated interior walls of the lineals 21, 22.

Figure 4:
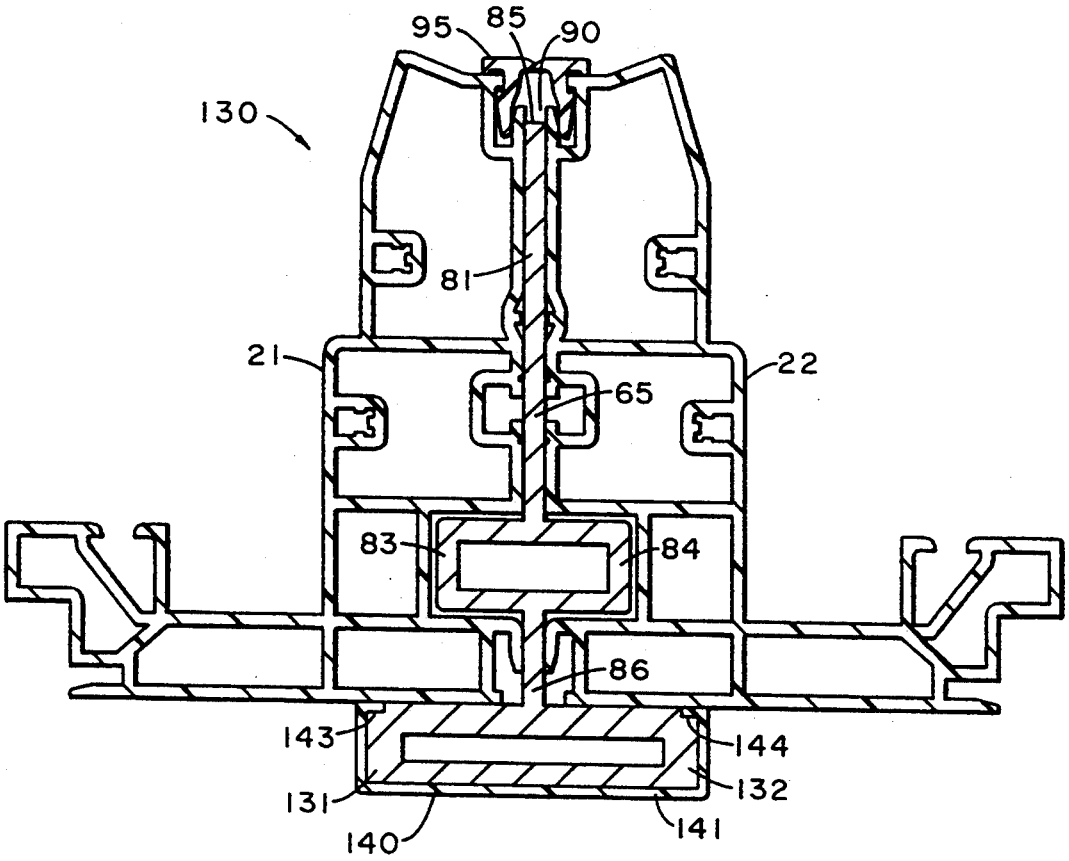
FIGS. 4 and 5 are cross-sectional views of metal reinforced mullions made in accordance with the invention.

A second preferred mullion 130 is shown in FIG. 4. The second mullion 130 includes a metal reinforcing bar 65 joining the first lineal 21 and second lineal 22. The bar 65 includes a blade 81 and first beam 83, 84 and exterior end 85 as described above for the first mullion 30.

The metal bar 65 is an aluminum alloy extrusion including a second beam 131, 132 having a first interior portion 131 interior of the first lineal 21 and a second interior portion 132 interior of the second lineal 22. The second beam 13 1, 132 is joined to an interior end 86 of the blade 81. A face cap 140 covers the second beam 131,132 to provide a uniform appearance on the interior side. The face cap 140 is a vinyl extrusion including a generally U-shaped cover plate 141 attached to fingers 143, 144 located adjacent respective lineals 21, 22.

Figure 5:
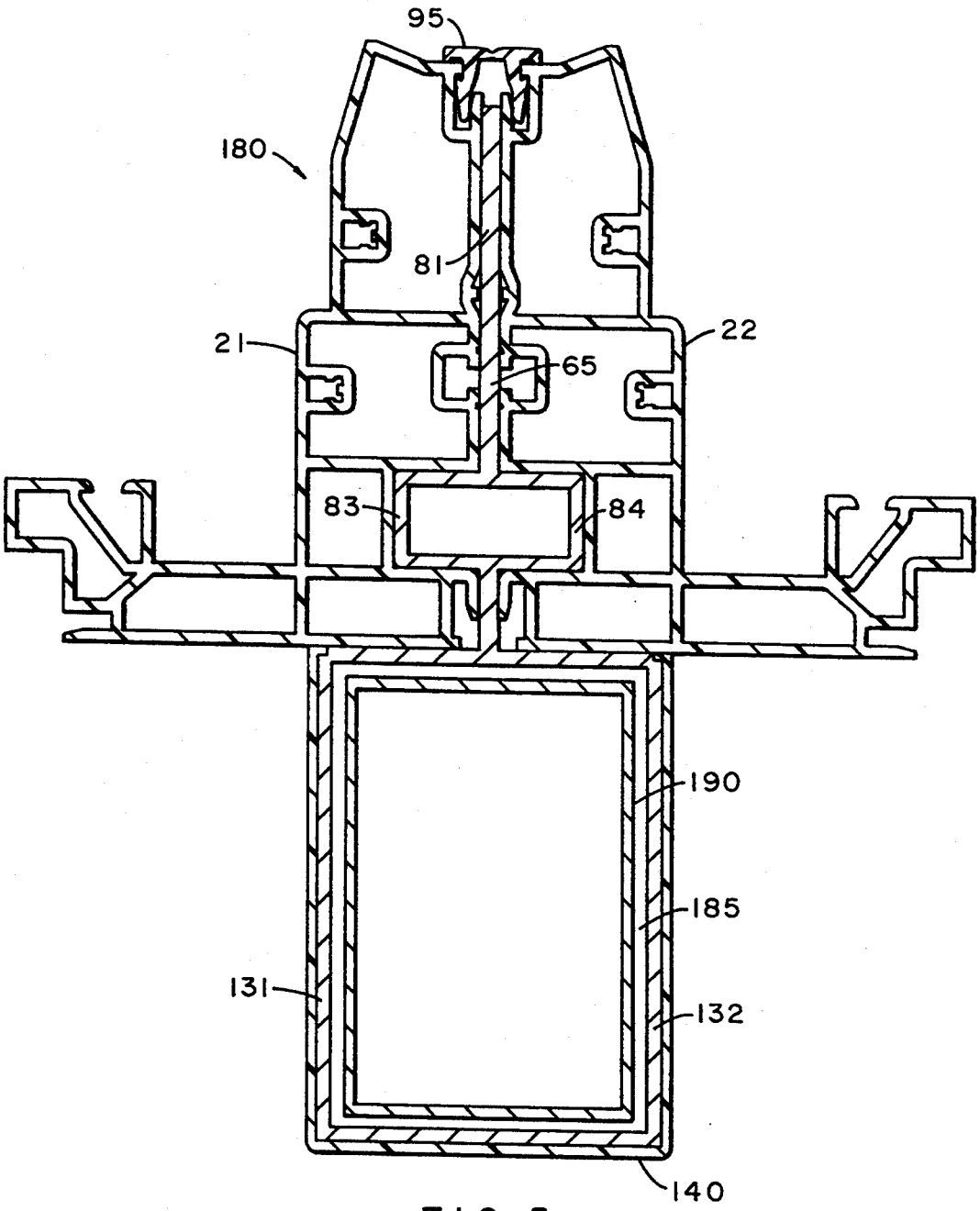

A third preferred reinforcing mullion 180 is shown in FIG. 5. The third mullion 180 has a metal reinforcing bar 65 including a blade 81, first beam 83, 84 and face cap 140 similar to the second mullion 130 described above. The metal bar 65 is an aluminum alloy extrusion wherein the second beam 13 1,132 defines an elongated hollow, generally rectangular cavity 185. A steel reinforcing bar 190 partially fills the cavity 185 inside the beam 131,132 as shown. The steel bar 190 is preferably an elongated hollow, generally rectangular structure.

Figure 7:
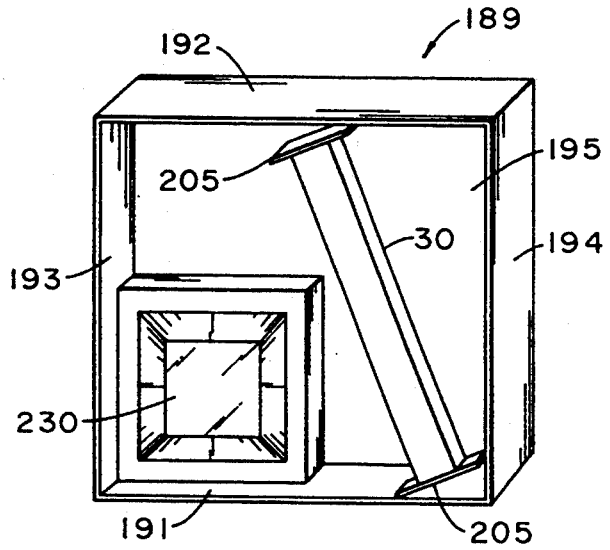
FIGS. 7 and 8 are perspective views showing a method for assembling window units into the window assembly of the invention.

Referring now to FIG. 7, a typical window support structure 188 includes generally horizontal supports or support studs 191, 192 joined to generally vertical supports or support studs 193, 194. The support studs 191, 192, 193, 194 may be made from wood or metal, and they define a generally rectangular window opening 195.

Figure 6:
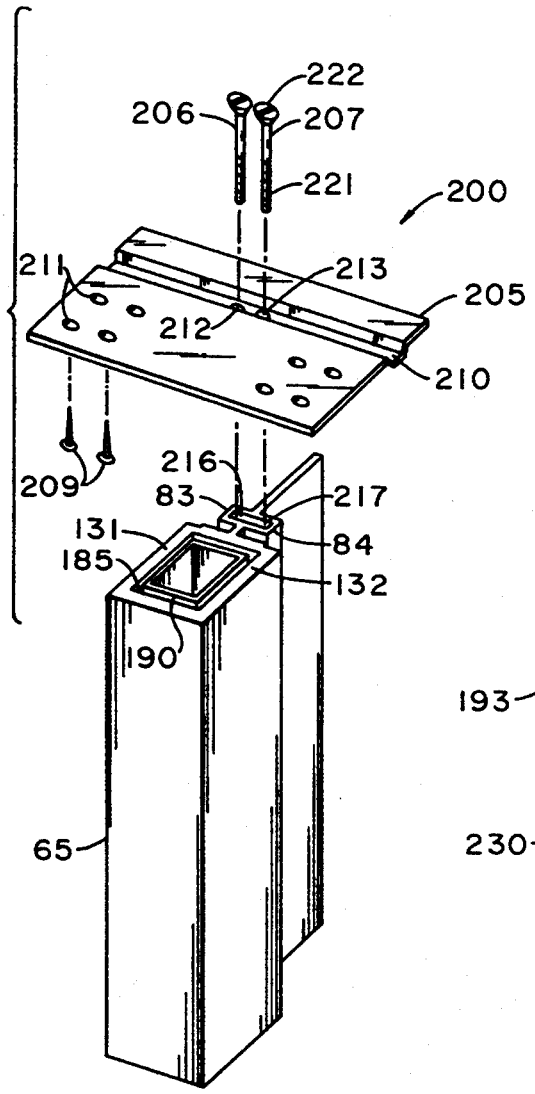
FIG. 6 is an exploded perspective view of a mullion of the invention showing the securement means.

There is shown in FIG. 6 a securement means 200 for attaching a window assembly of the invention to the support structure 188 of FIG. 7. The preferred securement means 200 includes a steel plate 205, two high strength steel bolts or posts 206, 207 and several wood screws 209 for attaching the plate to the support structure 188. The plate 205 defines a long laterally extending recess 210 and through openings 211 sized for insertion of the screws 209.

Figure 8:
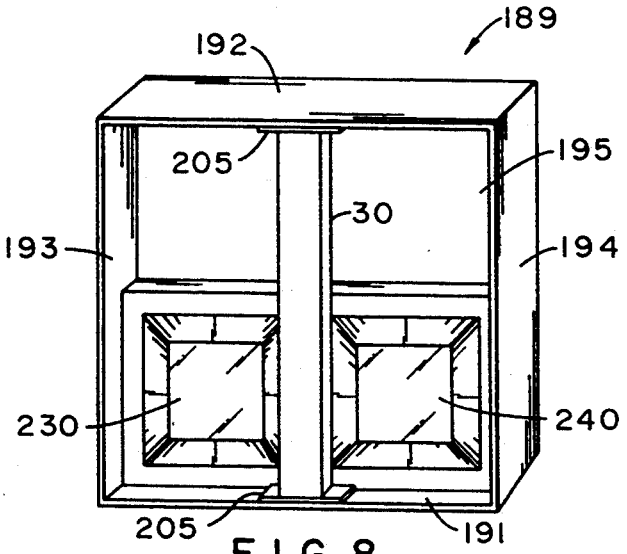
Figure 9:
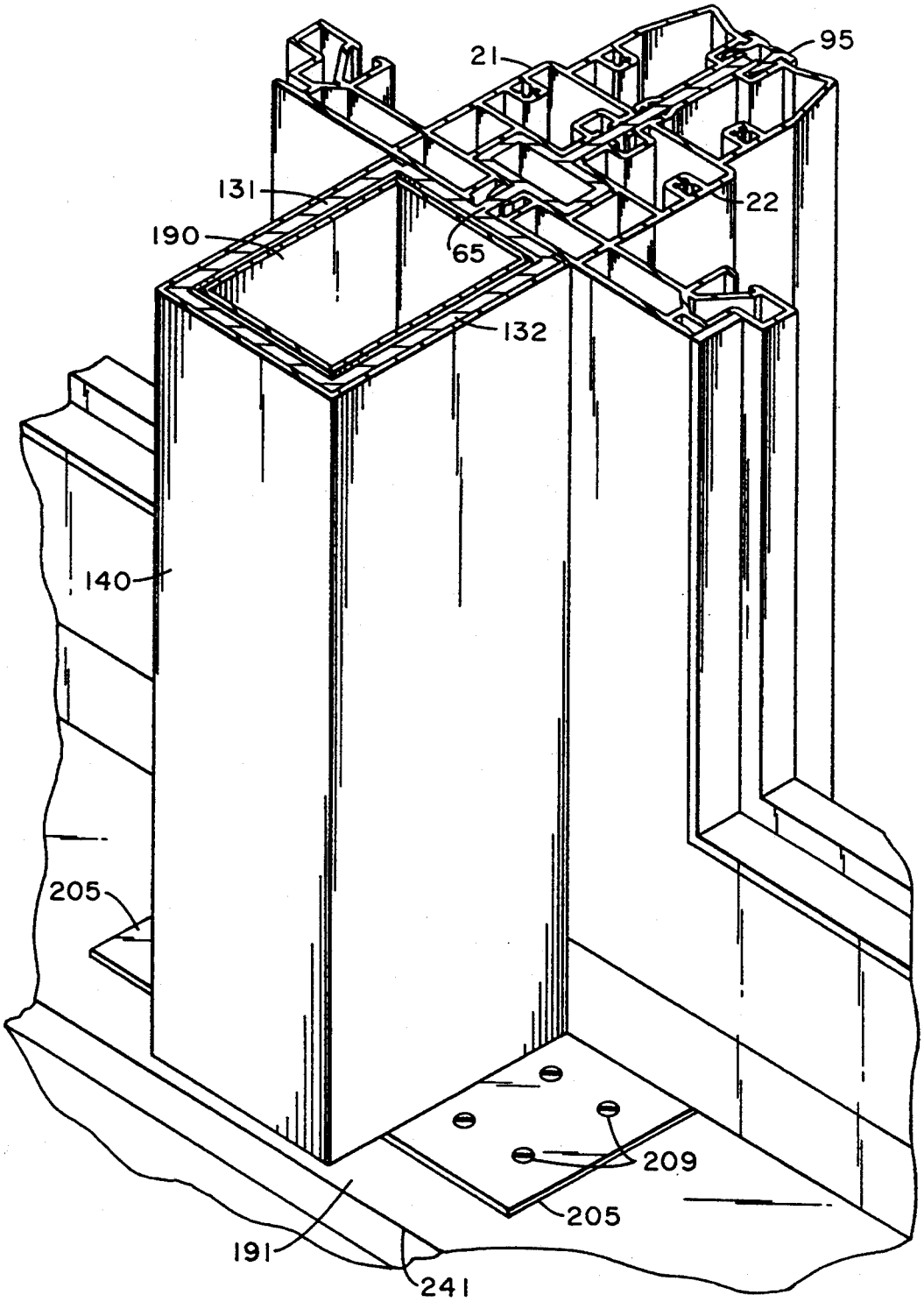
FIG. 9 is a fragmentary perspective view of the window assembly of FIG. 8.

Referring now to FIGS. 6–9, a steel reinforcing bar 190 is inserted into a cavity 185 of the second beam 131,132 in the aluminum reinforcing bar 65. A steel plate 205 is positioned adjacent an open end of the bar 65, and high strength bolts 206, 207 are inserted through holes 212, 213 in the plate 205 and threaded into end openings 216, 217 in the first beam 83, 84. Each bolt includes a proximal end portion or shaft 221 threaded into an end opening and a distal portion or head 222 adjacent the metal plate 205 in the groove 210. If desired, putty or another preferred sealant (not shown) may be placed in the end openings 216, 217 adjacent the bolt shafts 221. After plates 205 are attached to both ends, the mullion 30 is fitted into the window opening 195 and screws 209 attach the plates 205 to the support studs 191,192. Attachment of one plate 205 to the lower support stud 191 is shown in FIG. 9. Lower window units 230, 240 are then positioned adjacent the mullion 30, as shown in FIG. 8. Upper window units (not shown) are added to close off the opening 195.

As shown in FIG. 9, the lower support stud 191 has an interior edge 241. The second beam 131,132 extends interiorly of the lineals 21,22 toward the edge 241. It is an advantage of the second and third embodiments described above that the second beam 131,132 does not extend over the interior edge 241. The second beam 131,132 may extend to the interior edge 241 but it should not overlap that edge 241. Another advantage of the invention is that the second beam 131,132 permits usage of standard window locks and operating hardware in the adjacent window units and does not narrow the view through panes of glass in these window units.

The foregoing description of our invention has been made with reference to three particularly preferred embodiments. Persons skilled in the art will understand that numerous changes and modifications may be made therein without departing from the spirit and scope of the following claims.

What is claimed is:

1. A window assembly comprising adjacent first and second windows each comprising a polymer frame, said windows being connected by a metal and plastic reinforcing mullion for increasing structural rigidity in said window assembly, said mullion comprising:

(a) an elongated polymeric first lineal defining an elongated first groove opening toward said second window;

(b) an elongated polymeric second lineal defining an elongated second groove opening toward said first window; and (c) a metal reinforcing bar including:

(i) a blade extending between said first and second lineals;

(ii) a first beam extending generally parallel to said lineals and projecting laterally outwardly from said blade, said first beam including a first portion extending into said first groove and a second portion extending into said second groove; and (iii) a second beam extending outwardly from said blade and including a first interior portion interior of said first lineal and a second interior portion interior of said second lineal.

2. The window assembly of claim I wherein said metal reinforcing bar comprises steel and said blade is welded to said first beam.

3. The window assembly of claim 1 wherein said first and second lineals define an elongated gap extending therebetween, said window assembly further comprising:

(d) an exterior face cap overlapping said gap, said exterior face cap being attached to exterior portions of said first and second lineals.

4. The window assembly of claim 3 wherein said window assembly further comprises:

(e) an elongated interior face cap overlapping said gap, said interior face cap being joined to interior portions of said first and second lineals.

5. The window assembly of claim 1 wherein said window assembly further comprises:

(d′) an elongated interior face cap covering said first interior portion and said second interior portion of the second beam.

6. The window assembly of claim 1 wherein said metal reinforcing bar comprises an aluminum alloy extrusion.

7. The window assembly of claim 1 wherein each said lineals comprises a hollow extrusion.

8. The window assembly of claim 1 wherein said metal reinforcing bar comprises an aluminum alloy extrusion, said second beam defines an elongated hollow cavity, and said window assembly further comprises:

(d″) an elongated steel bar in said cavity.

9. The window assembly of claim 1 further comprising:

(d‴) securement means for attaching said metal reinforcing bar to a support structure surrounding a window opening in a building.

10. The window assembly of claim 9 wherein said first beam defines an end aperture and said securement means comprises:

(i) a metal plate for attachment to a support structure surrounding a window opening in a building; and (ii) at least two metal posts each including a proximal end portion inserted in said end aperture and a distal portion attached to said metal plate.

11. The window assembly of claim 1 further comprising a window support structure including a generally horizontal support stud having an interior edge.

12. A metal and polymer reinforcing mullion for increasing rigidity in a window assembly including adjacent windows having polymer frames, said mullion comprising elongated hollow polymer first and second lineals each defining a groove facing laterally outwardly thereof, and a metal reinforcing bar including an elongated blade adapted to extend into a gap between the first and second lineals and a first beam having first and second portions extending laterally outward of the blade, said first and second portions being sized for insertion into said grooves, said reinforcing bar further including a second beam spaced from said first beam and extending laterally outward of said blade.

13. The mullion of claim 12 further comprising an exterior face cap spanning said gap and means for attaching said exterior face cap to said first and second lineals.

14. The mullion of claim 13 further comprising an interior face cap spanning said gap and means for attaching said interior face cap adjacent said first and second lineals.

15. The mullion of claim 13 further comprising securement means for attaching said metal reinforcing bar to a support structure, said securement means comprising a metal plate defining at least two openings, and at least two metal posts each including a proximal portion sized for insertion into an end portion of said reinforcing bar and a distal portion sized for insertion through an opening in the metal plate.

16. The mullion of claim 15 wherein securement means further comprises means for attaching said metal plate to a support structure in a building.

17. The mullion of claim 13 wherein said metal reinforcing bar comprises a steel blade welded to a steel first beam.

18. The mullion of claim 13 wherein said metal reinforcing bar comprises an aluminum alloy extrusion defining a cavity.

19. The mullion of claim 18 wherein said metal reinforcing bar further comprises an elongated steel bar in said cavity.

20. A reinforcing mullion for increasing rigidity in an assembly comprising adjacent fenestrations, said mullion comprising:

(a) an elongated, hollow polymer first lineal defining an elongated first groove;

(b) an elongated, hollow polymer second lineal defining an elongated second groove opening toward said first groove; and (c) a metal reinforcing bar comprising:

(i) a blade extending between the first and second lineals;

(ii) a first beam projecting laterally outward from said blade and including a first portion extending into said first groove and a second portion extending into said second groove; and (iii) a second beam spaced interiorly of said first beam and extending laterally outward of said blade, said second beam including a first interior portion interior of said first lineal and a second interior portion interior of said second lineal.

21. The mullion of claim 20 wherein said reinforcing bar comprises an aluminum alloy extrusion and said second beam defines an elongated cavity.

22. The mullion of claim 21 further comprising:

(iv) an elongated steel bar in said cavity.

* * * * *